US005818471A

United States Patent [19]

Shimamura et al.

[11] Patent Number: 5,818,471

[45] Date of Patent: Oct. 6, 1998

[54] RECORDING APPARATUS AND METHOD FOR INDICATING DECREASE OF INK REMAINS

[75] Inventors: Yoshiyuki Shimamura, Yokohama; Osamu Asakura, Sagamihara; Masasumi Nagashima, Yokohama; Kenji Kawazoe, Yokohama; Kazuya Iwata, Yokohama; Seiji Takahashi, Yokohama; Yuji Kanome, Yokohama; Tetsuya Ishikawa, Yokohama; Takahiro Ohde, Yokohama, all of Japan

[73] Assignee: Canon Kabushiki Kaisha, Tokyo, Japan

[21] Appl. No.: 440,469

[22] Filed: May 12, 1995

[30] Foreign Application Priority Data

May 19, 1994 [JP] Japan ..... 6-105296

[51] Int. Cl.[6] ..... B41J 29/38; B41J 2/195

[52] U.S. Cl. ..... 347/7; 347/5

[58] Field of Search ..... 347/5, 7; 73/290 R, 73/302, 307, 312, 314

[56] References Cited

U.S. PATENT DOCUMENTS

| | | | |
|---|---|---|---|
| 4,178,595 | 12/1979 | Jinnai et al. | 346/140 R |
| 4,202,267 | 5/1980 | Heinzl et al. | 101/364 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,719,475 | 1/1988 | Kiyohara et al. | 346/140 R |
| 4,723,129 | 2/1988 | Endo et al. | 347/56 |
| 4,740,796 | 4/1988 | Endo et al. | 347/56 |
| 5,132,711 | 7/1992 | Shinada et al. | 347/7 |
| 5,315,317 | 5/1994 | Terasawa et al. | 347/7 |

FOREIGN PATENT DOCUMENTS

| | | | |
|---|---|---|---|
| 54-056847 | 5/1979 | Japan . | |
| 54-083433 | 7/1979 | Japan . | |
| 59-089161 | 5/1984 | Japan . | |
| 59-123670 | 7/1984 | Japan . | |
| 59-138461 | 8/1984 | Japan . | |
| 60-071260 | 4/1985 | Japan . | |
| 60-90766 | 5/1985 | Japan | B41J 3/04 |
| 62-092850 | 4/1987 | Japan . | |
| 62-288046 | 12/1987 | Japan | B41J 3/04 |
| 1195049 | 8/1989 | Japan | B41J 3/04 |
| 3159750 | 7/1991 | Japan | B41J 2/175 |
| WO9211513 | 7/1992 | WIPO | G01F 23/16 |

*Primary Examiner*—N. Le
*Assistant Examiner*—L. Anderson
*Attorney, Agent, or Firm*—Fitzpatrick, Cella, Harper & Scinto

[57] ABSTRACT

A recording apparatus for recording by discharging plural kinds of ink from the recording head to a recording medium comprises detection device for detecting the decrease of ink remains of each ink of the plural kinds of ink, ink amount indication device arranged in a number smaller than the number of the plural kinds of ink, and signal outputting device for outputting signals which enables the decrease of ink remains having the least amount of ink remains to be displayed on the ink amount indication device in accordance with the results of plural detections by the detection device. In this way, only the ink remains having the least ink remains among those kinds of ink in use is indicated on the display, not the ink remains of all the kinds of ink, thus making it possible to minimize the number of indication devices to make the indication device simpler and smaller or minimize the area on the screen of the display assigned for indicating the ink remains in order to save it for indicating more information other than the ink remains.

13 Claims, 9 Drawing Sheets

RECORDING APPARATUS AND METHOD FOR INDICATING DECREASE OF INK REMAINS

BACKGROUND OF THE INVENTION

1. Field of the Invention

The present invention relates to a recording apparatus and a method for indicating decrease of ink remains. More particularly, the invention relates to a technique for indicating decrease of ink remains for an ink jet recording apparatus.

2. Related Background Art

For an ink jet recording method, the structure is arranged to supply liquid ink to the recording head, and discharge ink from the discharge ports of the recording head which is arranged to face a recording medium, thus forming flying ink droplets and causing them to adhere to the recording medium for recording. Also, for an ink jet recording method of the kind, it is generally practiced to employ a recovery system for sucking ink from the ink discharge ports (suction recovery) in order to remove, together with ink, any foreign particles that may cause the defectives, such as ink residue, paper particles and dust adhering to the ink discharge ports, and air bubbles intermingled into the ink discharge ports, when the recording head is not used for printing or recording and left intact for a long time, or to employ a recovery system for causing such foreign particles to be exhausted together with ink by pressurizing the ink supply system or performing a predetermined ink discharge operation (ink predischarge) instead of or together with these means for performing the forced removal.

For the ink jet recording method described above, there has been arranged a structure whereby to issue a warning or indicate errors if ink remains are lowered than a given level when ink is consumed by these means for recording and executing recoveries.

However, in accordance with the conventional system described above, the problems are encountered that neither it is possible to know the remaining amount of ink with respect to the ink remains changing each time a recording or suction recovery is operated, nor is it possible to know the timing for preparing a new ink supply until the ink is completely exhausted. Also, for an ink jet recording method which uses various kinds of ink, such as the one adopted for a color ink jet recording method, it becomes extremely complicated if all the ink remains should be indicated. Not only it costs high to prepare such a complicated display, but also, it requires an extra space for ink remains to be indicated on a display. This inevitably sacrifices the space which should otherwise be available for indicating other information than the ink remains. There is also a problem, among others, that if the indication of ink remains should be updated often, the other data processing for printing is to be on standby while the controller is busy on processing to update the indication of ink remains. Hence it takes more time to execute a recording by that much, leading to a problem of lowered throughput of the apparatus as a whole.

SUMMARY OF THE INVENTION

The present invention is designed with a view to solving the problems described above. It is an object of the invention to provide a recording apparatus having a simple and small means for indicating ink remains, and also, to provide a recording apparatus capable of minimizing the reduction of recording speed resulting from the execution of indication processing of ink remains.

It is another object of the invention to provide a recording apparatus for recording by discharging plural kinds of ink from the recording head to a recording medium, comprising detection means for detecting ink remains each for the plural kinds of ink; indication means for indicating ink amount arranged in a number smaller than the number of the plural kinds of ink to be used; and signal outputting means for outputting signals enabling the aforesaid ink amount indication means to indicate the decrease of ink remains having the least ink remains in accordance with the results of plural detections by the aforesaid detection means.

It is still another object of the invention to provide a recording apparatus for recording by discharging plural kinds of ink from the recording head to a recording medium, comprising first detection means for detecting the decrease of ink remains of a first ink tank retaining black ink; second detection means for detecting the decrease of ink remains of a second ink tank retaining plural kinds of color ink other than black ink; first ink amount indication means for indicating the decrease of ink remains in the first ink tank; second ink amount indication means for indicating the decrease of ink remains of the second ink tank; and signal outputting means for outputting signals enabling the first ink amount indication means to indicate the decrease of ink remains in accordance with the result of detection by the first detection means, and for outputting signals enabling the second ink amount indication means to indicate the ink remains having the least ink remains in accordance with the results of plural detections by the second detection means.

It is a further object of the invention to provide a method for indicating ink remains for a recording apparatus for recording by discharging plural kinds of ink from the recording head to a recording medium, which is provided with ink amount indication means arranged in a number smaller than the numbers of plural kinds of ink to be used, comprising the steps of detecting ink remains each for the plural kinds of ink, and of enabling the aforesaid ink amount indication means to indicate the ink remains having the least ink remains in accordance with the results of plural detections.

It is still a further object of the invention to provide a recording apparatus for recording by discharging ink from the recording head to a recording medium, comprising detection means for detecting the decrease of ink remains; indication means for indicating the result of detection by the detection means; and updating means for updating the result of detection to be indicated by the indication means in accordance with the result of detection which is output from the detection means when the recording apparatus has completed a given operation.

In accordance with a recording apparatus of the present invention described above, it is possible to make its indication system smaller, and also, make the replacement timing of each ink tank easily recognizable. Further, it is possible to prevent the recording time from becoming longer due to the indications of ink remains.

DETAILED DESCRIPTION OF THE PREFERRED EMBODIMENTS

Hereinafter, in conjunction with the accompanying drawings, the specific description will be made of each embodiment in accordance with the present invention.

Figure 1:
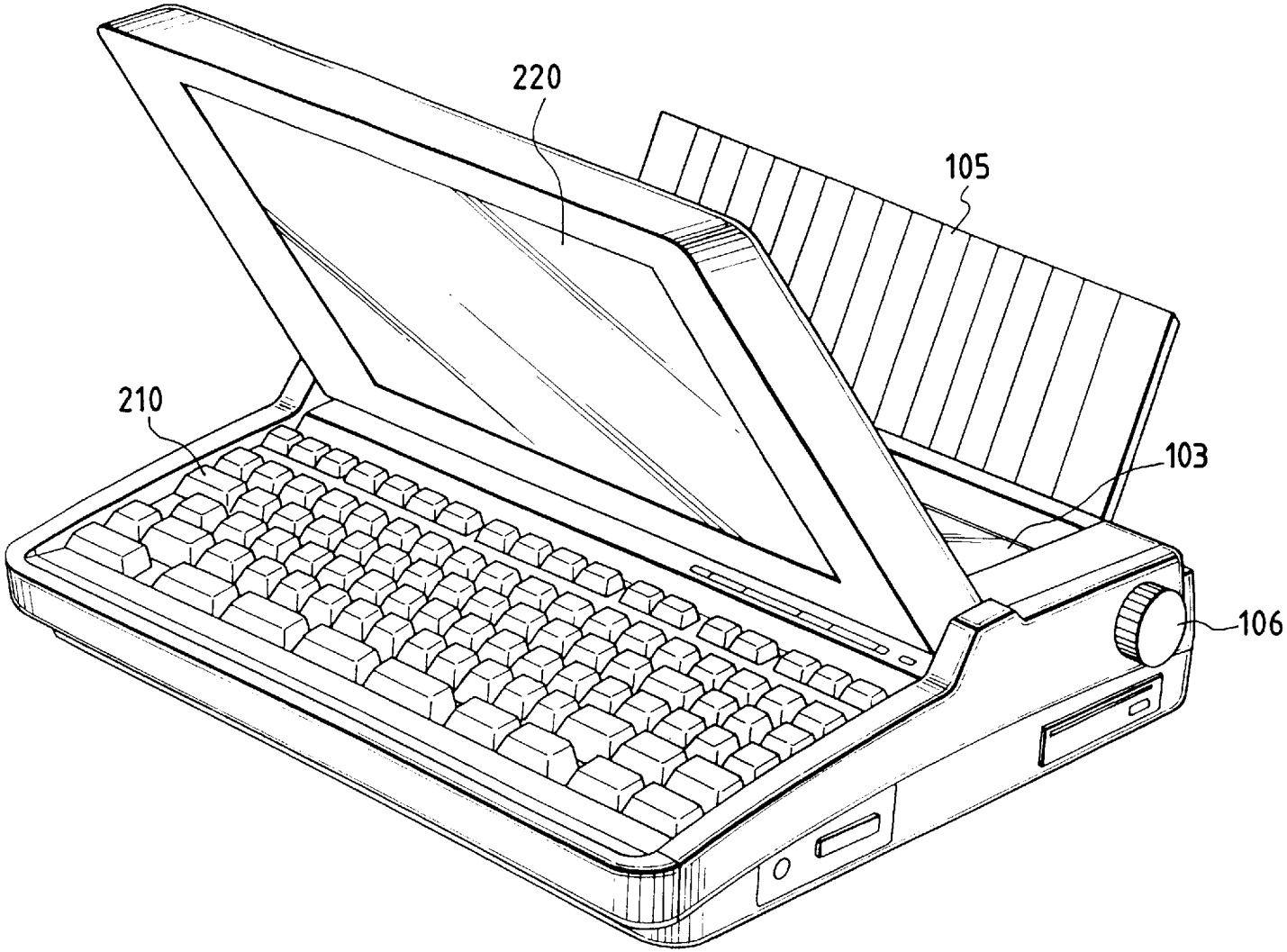
FIG. 1 is a structural view which shows the external appearance of an ink jet type wordprocessor in accordance with one embodiment of the present invention.

FIG. 1 is a structural view which shows the external appearance of one embodiment of a document processing apparatus (hereinafter referred to as a wordprocessor) having an ink jet recording apparatus as an apparatus to which the present invention is applicable. In FIG. 1, a reference numeral 210 designates a keyboard unit serving as an input device; 220, the unit of indication device rotatively held for displaying a document or the like to be inputted, which is structured to be folded up over the keyboard unit 210. In a portion at 103, an ink jet recording apparatus is incorporated. A reference numeral 105 designates a paper supporter for supporting a recording sheet when it is exhausted; and 106, a knob for feeding or removing a recording sheet manually.

Figure 2:
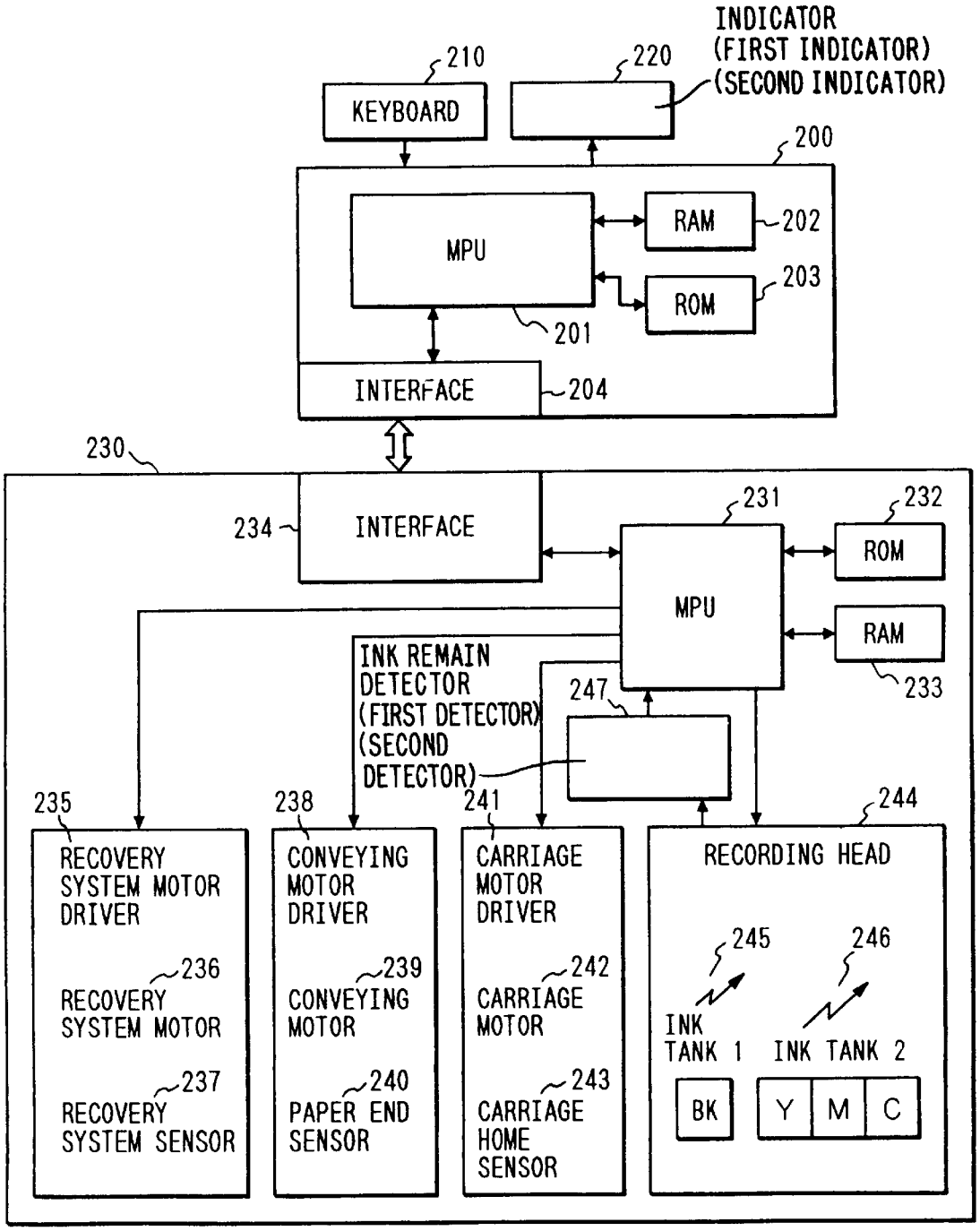
FIG. 2 is a structural block diagram which shows a control system of the apparatus represented in FIG. 1.

FIG. 2 is a block diagram which shows the structural example of the control system of the apparatus represented in FIG. 1. The region indicated by a reference numeral 200 designates a microcomputer which is the main body of the wordprocessor. A reference numeral 201 designates a microprocessor unit (hereinafter referred to as the host MPU); 203, a ROM storing the wordprocessing programs and means for indicating ink remains which will be described later; 202, a RAM used as a work area when processing documents and others. The user inputs information into the microcomputer 200 through the keyboard 210, and confirms the contents of intended operation by observing the display unit 220 formed by a liquid crystal display and others. The region indicated by a reference numeral 230 designates an ink jet recording apparatus incorporated in it.

A reference numeral 231 designates a microprocessor unit (hereinafter referred to as the printer MPU); 232, a ROM storing a controller for the recording apparatus and the program required for detecting ink remains which will be described later; 233, a RAM used as a work area when performing recording and others. The printer MPU 231 supplies driving pulses to a conveying motor driver 238, a carriage motor driver 241, a recovery system motor driver 235 to control the conveying motor 239, the carriage motor 242, and the recovery motor 236, while sensing the presence and absence of a recording sheet, the carriage positions, and the unit status of the recovery systems by use of a paper end sensor 240, a carriage home sensor 243, and a recovery system sensor 237.

From the host MPU 201, printing instructions and recording data are transferred to the printer MPU 231 through an interface 204. From the printer MPU 231, inner information of the printer, such as ink remains, is transferred to the host MPU 201 through an interface 234. Here, a reference numeral 244 designates an ink jet recording head which is controlled by the printer MPU 231 to record the print data transferred from the host MPU 201 through the interface 204.

Also, the recording head 244 installs on it two detachable ink tanks, that is, an ink tank 1 at 245 and an ink tank 2 at 246. In the ink tank 1, black ink (Bk) is retained. In the ink tank 2, three kinds of ink, yellow (Y), Magenta (M), and Cyan (C), are retained. Here, it is assumed that the three kinds of ink are arranged to be exchangeable at a time per tank, not by each kind of ink, and then, ink remains can be detected by the ink remain detection device 247 per ink. The results of detections are transferred to the printer MPU 231. Also, the host MPU 201 is structured to indicate on the display 220 the ink remains transferred from the printer MPU 231 through the interface 234. In this respect, as an ink detection device, it is possible to apply a known ink remain device of such a type as to detect the decrease of ink remains by sensing the lowered pressure in the ink passage, besides the device which calculates the ink remains by counting the dot numbers of ink discharged from the head.

Figure 3:
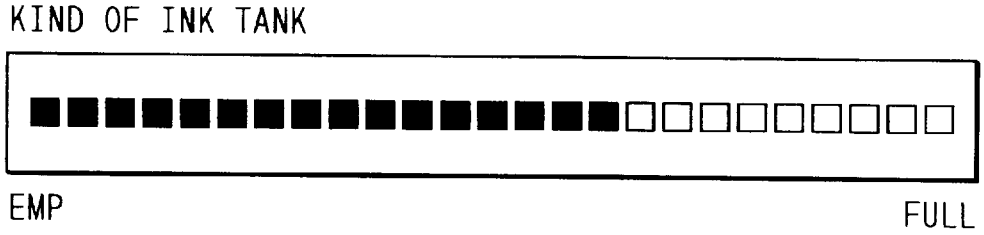
FIG. 3 is an example of ink remain indication.

Now, on the display 220 described above, the ink remains are indicated in a mode represented in FIG. 3 as an example therefor, hence making it possible to confirm the ink amount currently remaining. As a display, it may be possible to adopt a mode whereby to arrange a plurality of light emitting diodes (LEDs) laterally or to use a liquid crystal display, for example.

(First Embodiment)

Figure 4:
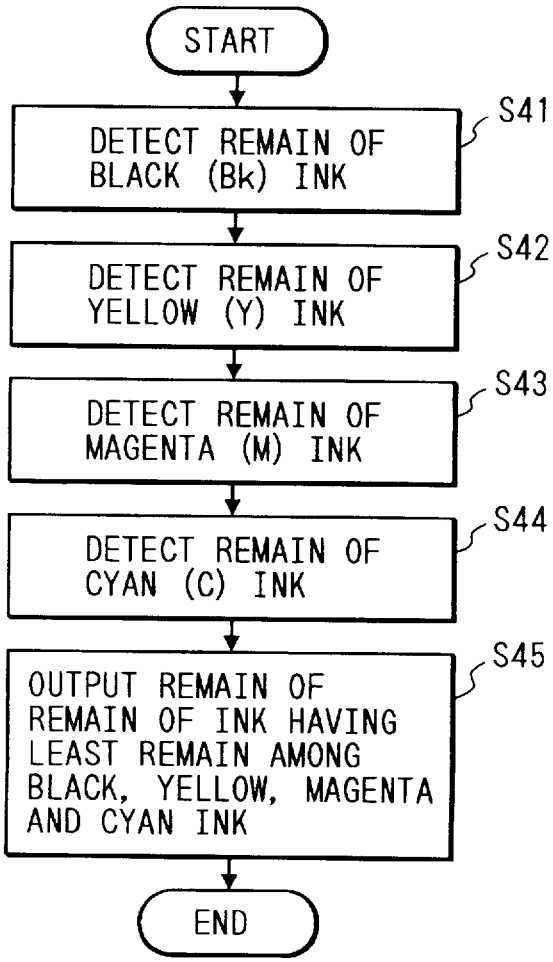
FIG. 4 is a sequential flowchart of control procedures for a first embodiment.

The description will be made of ink remain indication means in accordance with a first embodiment of the present invention using the structure described above. As an example, four kinds of ink, Bk, Y, M, and C, and one ink remain indication means are employed in this case, and the explanation is made in accordance with a sequential flowchart of control procedures shown in FIG. 4.

At first, the host MPU 201 instructs the printer MPU 231 to output ink remains to the interface 234. Receiving this instruction, the printer MPU 231 detects the ink remains of Black ink in step S41. In step S42, it detects the ink remains of Y ink. In step S43, it detects the ink remains of M ink, and in step S44, it detects the ink remains of C ink. Then, proceeding to step S45, the printer MPU outputs to the interface 234 the ink remains of the ink color having the least amount thereof among the ink remains of Bk, Y, M and C detected in the steps S41 to S44, together with the kind of ink tank which retains the ink having the least amount of ink remains at that time. Thus, as shown in FIG. 3, the host MPU 201 indicates on the display 220 the ink remains and the kind of ink than thereof thus transferred from the printer MPU 231.

With the structure described above, it is possible to attain making the ink remain indication means smaller, and at the same time, easily recognize the timing for each ink tank to be replaced.

(Second Embodiment)

Figure 5:
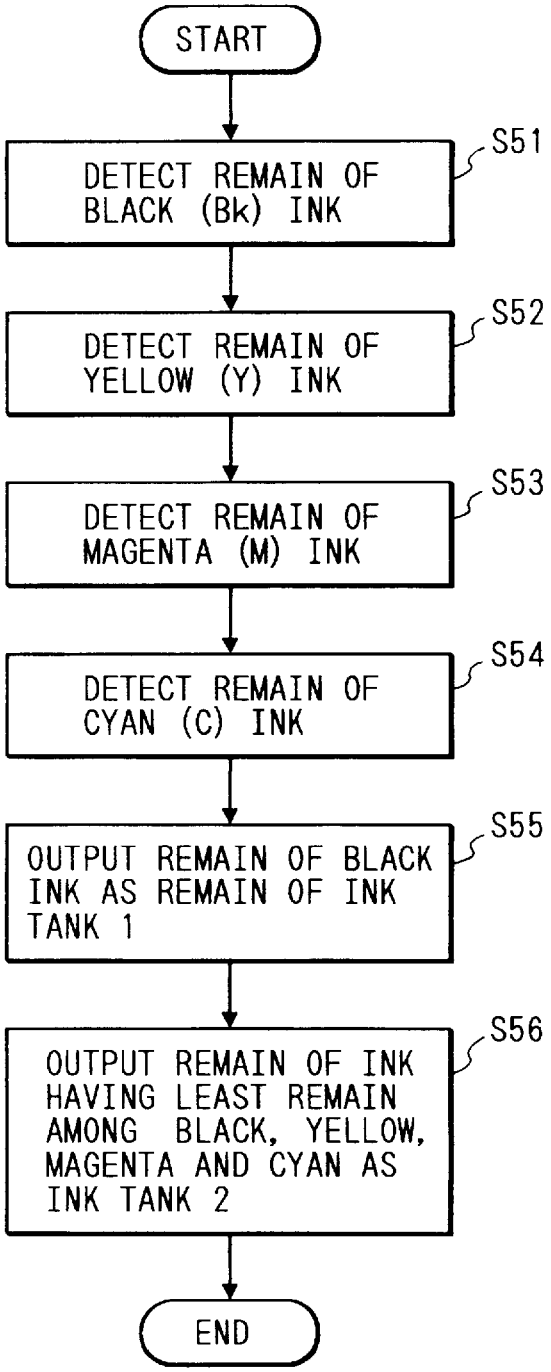
FIG. 5 is a sequential flowchart of control procedures for a second embodiment.

Now, with the structure shown in FIG. 1 to FIG. 3, the description will be made of a second embodiment of ink remain indication means in accordance with the present invention. For explanation, the sequential flowchart of control procedures shown in FIG. 5 is used in this case.

At first, the host MPU 201 instructs the printer MPU 231 to output ink remains to the interface 234. Receiving the instruction, the printer MPU 231 detects the ink remains of Bk ink in step S51. In step S52, it detects the ink remains of Y ink. In step S53, it detects the ink remains of M ink. In step S54, it detects the ink remains of C ink. Then, proceeding to step S55, the printer MPU outputs to the interface 234 the ink remains of Bk ink which has been detected in the step S51 as the ink remains in the ink tank 1 because the ink tank 1 retains only Bk ink in it.

Figure 8:
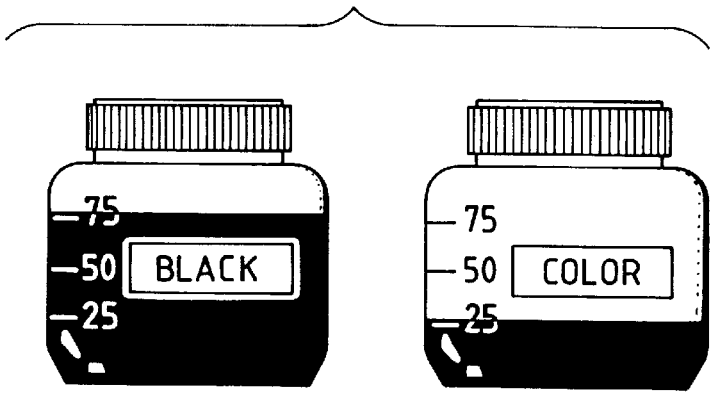
FIG. 8 is a view which shows one example of ink amount indication means for use of black ink and color ink.

Next, proceeding to step S56, the printer MPU outputs to the interface 234 as the ink remains in the ink tank 2 the ink remains having the least amount thereof among those ink remains of Y, M, and C which have been detected in the steps S52 to S54, respectively, because the three colors of ink are retained in the ink tank 2. In this way, the host MPU 201 separately indicates on the display 220 the ink remains in the ink tank 1 and ink tank 2 as received from the printer MPU 231 in such a manner as illustrated in FIG. 8 in order to identify each of the ink tanks as the one for Bk use and the other for Y, M, and C use. In FIG. 8, ink bottles are illustrated each for the Bk use and color use, and then, as the ink remains are being reduced, each portion in the ink bottles, colored in black, is gradually decreased from the top to the bottom accordingly.

With the structure described above, there is no need for the provision of indication means all for the four colors, but only one for the Bk ink retained in the ink tank 1 and the other for three colors retained in the ink tank 2, hence making it possible to reduce the size of the indication means significantly. Also, it becomes easier to recognize the kinds of ink whose remaining amount is reduced.

(Third Embodiment)

Figure 6:
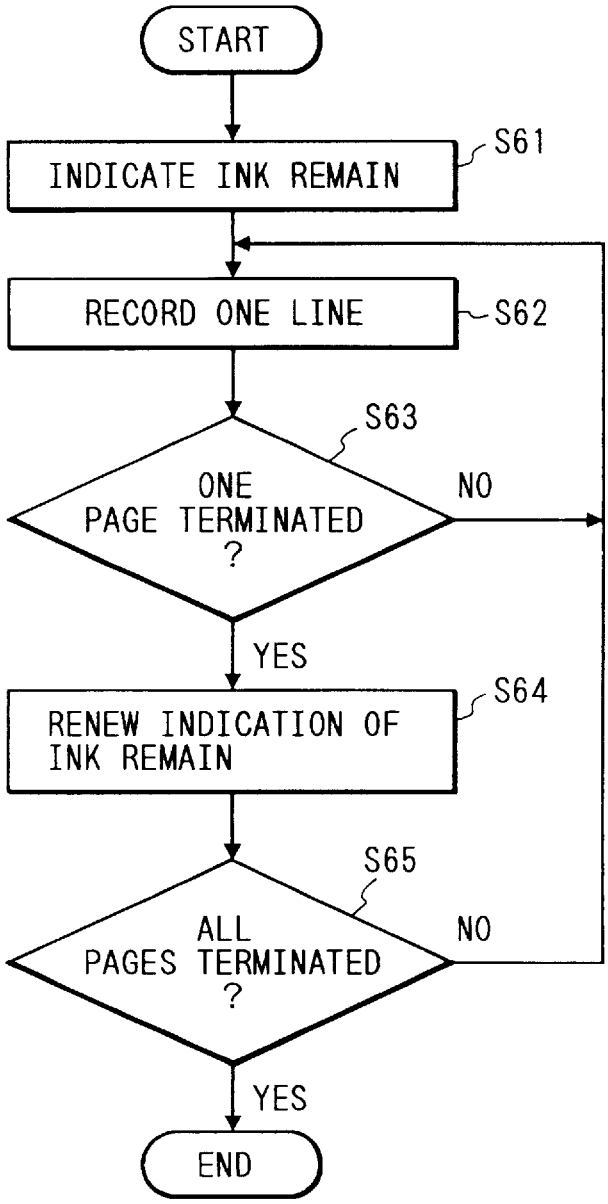
FIG. 6 is a sequential flowchart of control procedures for a third embodiment.

Next, using the structure shown in FIGS. 1 to 3 the description will be made of an ink remain indication in accordance with a third embodiment of the present invention. For explanation, the sequential flowchart of control procedures shown in FIG. 6 is used with the timing for updating the ink remain indication per page as a unit, for example.

At first, when a recording instruction is inputted through the keyboard 210, the host MPU 201 receives the ink remains from the printer MPU 231, and indicates them on its display in step S61. Then, proceeding to step S62, the host MPU transfers one-line portion of recording (print) data to the printer MPU 231 for recording. Thus, in step S63, it is determined whether or not the one-page portion of recording is completed. If not, the process returns to the step S62 for the execution of next-line recording. If it is found in the step S63 that the one-page recording is completed, the host MPU receives the ink remains from the printer MPU 231 in step S64, and updates the indication of ink remains. In this way, it is determined in step S65 whether or not the entire pages are recorded. If not, the process returns to the step S62 for the execution of next page. If completed, the process is terminated.

As described above, it is possible to prevent the reduction of the throughput of printing operation due to ink remain detections by setting the timing and executing the updating of ink remain indication per recording, that is, per page in the present embodiment, for example. In other words, there is no need for the controller in the printer main body to operate the ink remain detection while each page is being recorded, thus making it possible to allow the controller to dedicate itself only to performing the data processing for the printing operation at that time.

(Fourth Embodiment)

Figure 7:
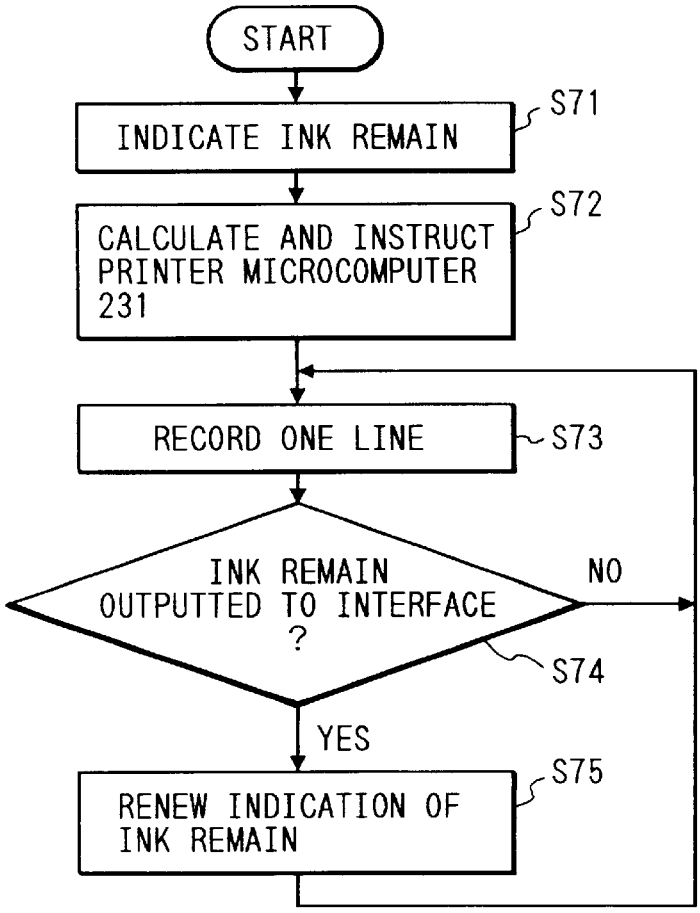
FIG. 7 is a sequential flowchart of control procedures for a fourth embodiment.

Next, using the structure shown in FIGS. 1 to 3 the description will be made of an ink remain indication in accordance with a fourth embodiment of the present invention. For explanation, the sequential flowchart of control procedures shown in FIG. 7 is used with the arrangement to update the ink remain indication per consumption of ink in an amount equivalent to increment an a scale of the ink remain indication illustrated in FIG. 3, for example.

At first, when a recording instruction is inputted from the keyboard 210, the host MPU 201 receives from the printer MPU 231 the ink remains having the least amount thereof among the Bk, Y, M, and C ink, and indicates it on the display in step S71. Then, in step S72, the host MPU calculates the ink consumption equivalent to one increment of indication illustrated in FIG. 3, for example. (Given the total ink quantity as xg, and the entire number of increments, as 25, an ink consumption equivalent to one increment is x/25g). Then it is arranged that the printer MPU 231 is instructed to output to the interface an ink remains equivalent to an amount when the ink of (x/25g) is consumed, that is, an amount equivalent to increment scale thus calculated. Subsequently, the process will proceed to step S73 where one-line recording data is transferred to the printer MPU 231 for recording. Then it is determined in step S74 whether or not any ink remains are output to the interface. If not, the process will return to the step S73 for execution of recording on the next line. If ink remains are output, the process will proceed to step S75 where the ink remain indication is updated, and then, returns to the step S73 for execution of recording on the next line. In other words, there is no way of indication even if any ink remains are detected while ink is being consumed in an amount equivalent to one increment on the scale illustrated in FIG. 3, for example. As a result, any indication of ink remains is not output to the interface, thus making it possible to implement the enhancement of the recording efficiency because there is no possibility that the MPU is caused to operate wastefully.

As described above, it is possible to prevent the reduction of throughput by making an arrangement to display the ink remain indication per given amount of ink consumption.

In accordance with the present invention, the structure is arranged, as described above, to indicate only the ink (whose remaining amount is so small that its indication becomes necessary). Consequently, there is no need for indicating all the ink remains of plural kinds of ink to be used. Also, it becomes easier to determine the timing for ink to be replaced, and at the same time, the indication device can be made smaller if an apparatus is provided with indication means dedicated to displaying ink remains. Further, if an apparatus shares use of a display screen, such as a wordprocessor, the area which the ink remain indication occupies on the screen can be made smaller, thus making more area available for displaying other information on it.

Also, for an apparatus which uses a plurality of ink tanks each arranged to retain plural kinds of ink as its ink and ink tank structure, it is only necessary to provide ink remain indications which agree with the number of ink tanks installed. There is no need for indicating all the kinds of ink for its remains. It also becomes easier to recognize the timing for each tank to be replaced.

Further, with the arrangement to make the timing for updating ink remains per page, it is possible to prevent the recording from taking more time due to the ink remain indications. It is also possible to minimize the recording time required for indicating ink remains, and change the ink remain indication smoothly by arranging to set the timing for updating ink remain indication per consumption of ink in an amount equivalent to one increment on the scale of the ink remain indication on the display.

The present invention produces an excellent effect on a recording apparatus using an ink jet recording method, particularly the apparatus in which the flying droplets are formed by utilizing thermal energy for recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, it is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously. The liquid (ink) is discharged with a quicker response accordingly.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermally activating portions are arranged in a curved region is also included in the present invention.

In addition, the present invention is effectively applicable to the structure disclosed in Japanese Laid-Open Patent Application No. 59-123670 wherein a common slit is used as the discharging ports for plural electrothermal transducers, and to the structure disclosed in Japanese Laid-Open Patent Application No. 59-138461 wherein an aperture for absorbing pressure wave of the thermal energy is formed corresponding to the discharging ports.

In addition, the present invention is effectively applicable to a replaceable chip type recording head which is electrically connected to the main apparatus and for which ink is supplied when the head is mounted on the main assemble, or to a cartridge type recording head having an ink tank integrally provided for the head itself.

Also, it is preferable to additionally provide the recording head recovery means, preliminarily auxiliary means, and the like. To name them specifically, such constituents are capping means for the recording head, cleaning means, compression or suction means, preliminary heating means such as electrothermal transducers or heating elements other than such transducers or the combination of those types of elements. Also, It is effective for the stabilized recording to adopt a predischarge mode which performs discharging other than the regular discharge for recording.

Further, as a recording mode of the recording apparatus, it may be possible to arrange an apparatus to be provided with at least one recording mode of full color having plural colors which differ from one another, full color prepared by mixing colors, or a major color such as black, irrespective of whether the recording head is formed integrally or formed by combining plural heads.

Now, in the embodiments described above in accordance with the present invention, the description has been made of ink as liquid, but it may be an ink material which is solidified below the room temperature but liquefied at the room temperature or a liquid material, or as the ink is, in general, controlled within the temperature not lower than 30° C. and not higher than 70° C. to stabilize its viscosity for the provision of the stable discharge for an ink jet type described above, the ink may be such as to be liquefied when the applicable recording signals are given.

In addition, while positively preventing the temperature rise due to the thermal energy by use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Laid-Open Patent Application No. 54-56847 or 60-71260 in order to enable the ink to face the electrothermal transducers. In the present invention, the most effective method for the various kinds of ink is the one capable of effectuating the film boiling method as described above.

Further, as the mode of the recording apparatus in accordance with the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

Figure 9:
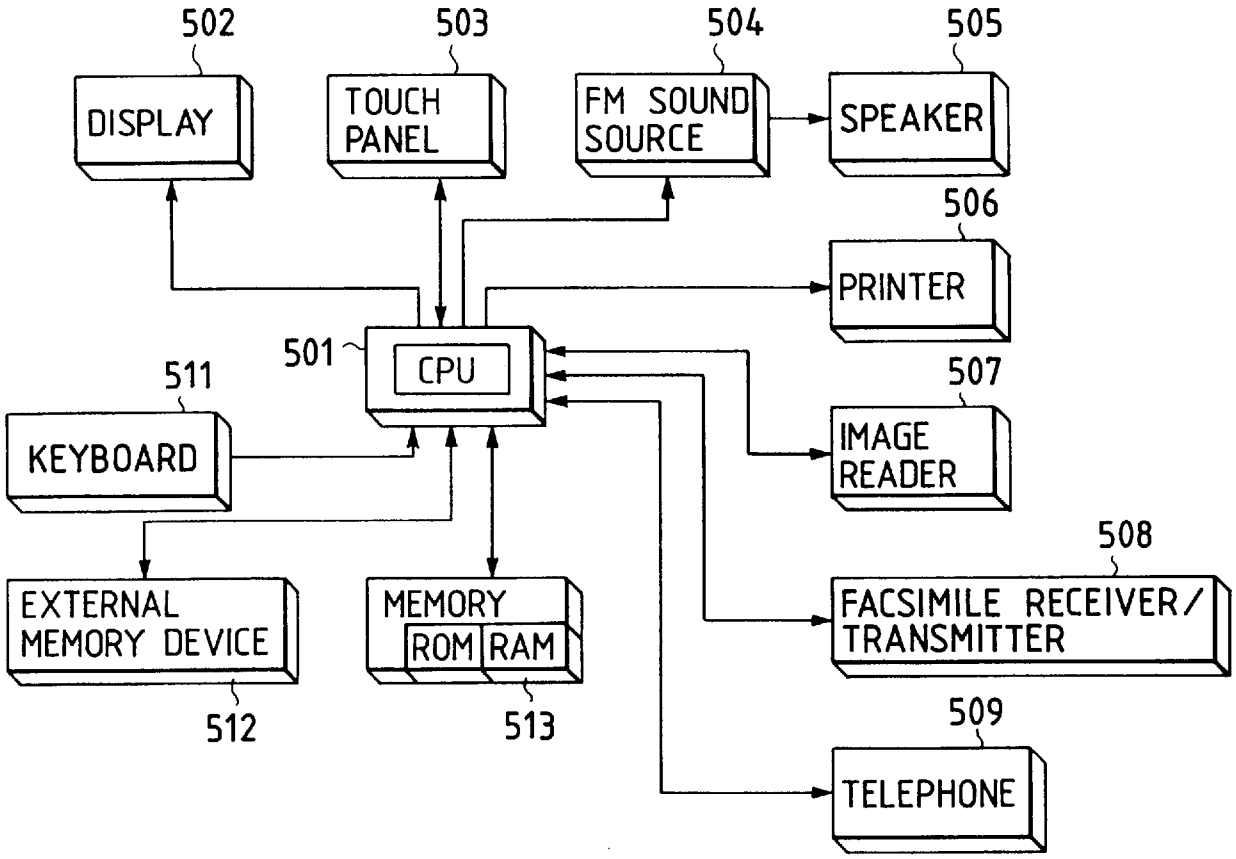
FIG. 9 is a block diagram which shows the schematic structure of a recording apparatus of the present invention, which is applicable to an information processing apparatus.

FIG. 9 is a block diagram which schematically shows the structure of a recording apparatus in accordance with the present invention in which the apparatus is applicable to an information processing apparatus having functions as a word processor, a personal computer, a facsimile apparatus, and a copying apparatus. In FIG. 9, a reference numeral 501 designates a control unit provided with a CPU such as a microprocessor, and various I/O ports to control the entire system of the apparatus by outputting control signals, data signals, and the like to each unit, and receiving control signals and data signals from each unit; 502, a display unit on the screen of which various menus, documentary information, and image data read by an image reader 507 are displayed among others; and 503, a pressure sensitive transparent touch panel arranged on the display unit 502 which allows items, coordinate positions, and other information to be inputted as indicated on the display unit 502 when its surface is depressed by a finger or the like accordingly.

A reference numeral 504 designates an FM (Frequency Modulation) sound generator which stores as digital data the music information created by a music editor or the like in a memory 510 and/or an external memory device 512, and reads them from the memory and others to perform an FM modulation. The electrical signals from the FM sound generator 504 are transduced into the audible sounds by a speaker unit 505. A printer unit 506 is the apparatus to which the present invention is applicable as an output terminal of a word processor, personal computer, facsimile apparatus, copying apparatus, electronic typewriter or the like.

A reference numeral 507 designates an image reader which is arranged on the feeding passage of source documents in order to photoelectrically read the data on them for facsimile and copying operations in addition to reading various other source documents; 508, a facsimile transmission and reception unit which performs the facsimile transmission of the data on the source document read by the image reader 507, and receives the transmitted facsimile signals for demodulation, and which also has a function to interface with the external devices; 509, a telephone unit which has various functions to serve as an ordinary telephone and an answering telephone as well so as to automatically take and record messages among others; and 510, a memory unit including the ROM which stores a system program, manager program, other application programs, character fonts, dictionaries, and the like, the RAM which stores the application program and text information loaded from the external memory device 512, and a video RAM among others.

A reference numeral 511 designates a keyboard unit arranged to input text information and various commands; 512, an external memory device using a floppy disk, hard disk, or the like as its storing medium. In this external memory device 512, text information, music, or voice information, and user's application program and others are stored.

Figure 10:
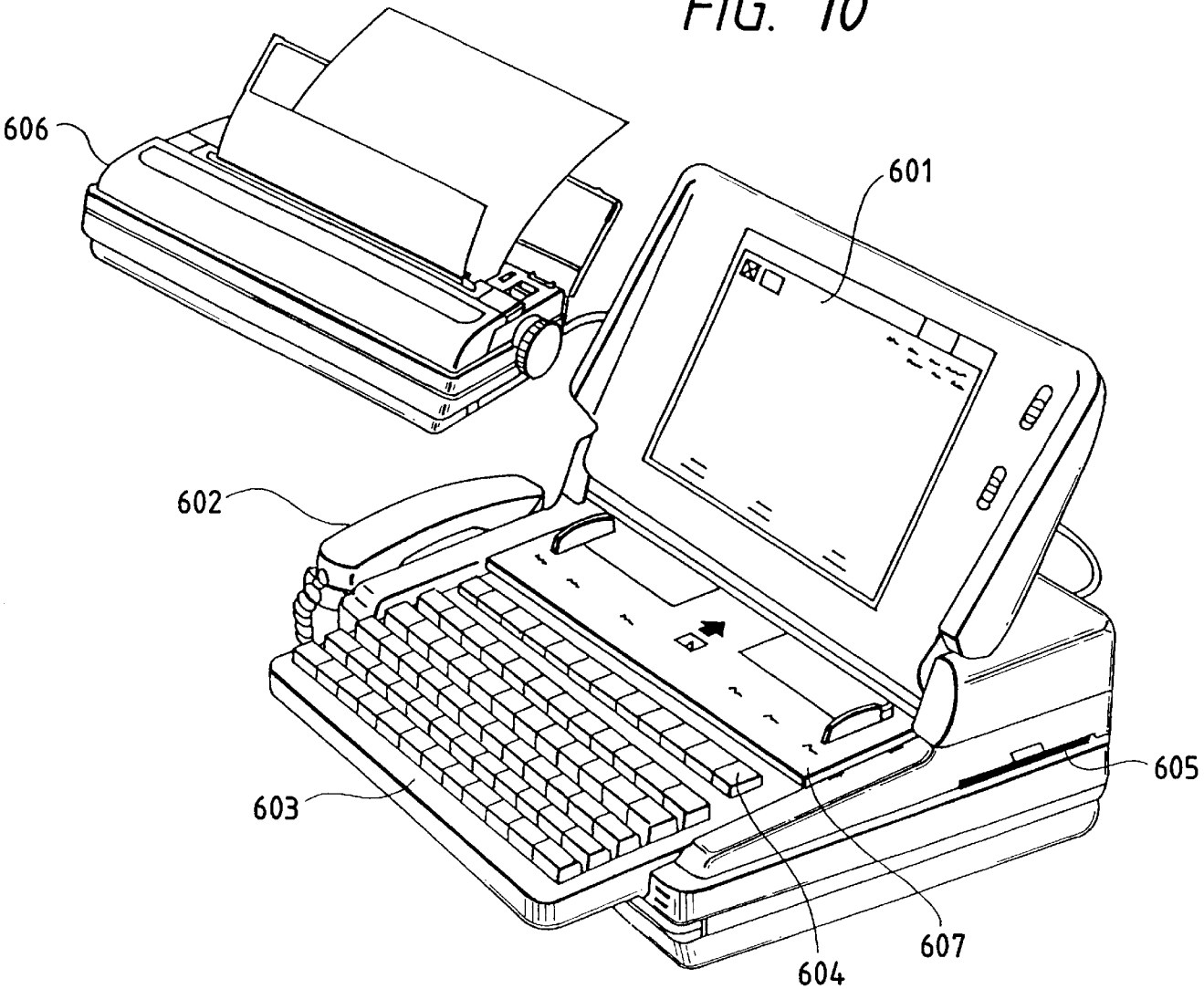
FIG. 10 is a view which shows the external appearance of an information processing apparatus.

FIG. 10 is a view which illustrates the external appearance of the information processing apparatus shown in FIG. 9. In FIG. 10, a reference numeral 601 designates a flat panel display which utilizes liquid crystal and others to display various menus, graphic information, and text information. This display is arranged to input the coordinates and specific items when the surface of the touch panel on the display 601 is touched as required by a finger or the like; and 602, a hand set which is used when the apparatus functions as a telephone unit.

The keyboard 603 is detachably connected to the main body by use of a cord, through which various text information and data can be inputted. Also, the keyboard 603 is provided with various functional keys 604 and others; and 605, an insertion inlet of a floppy disk.

A reference numeral 607 designates a sheet stacker in which the source documents are stacked for the image reader 607 to read, and the source document thus read are exhausted from the rear portion of the apparatus. Also, in a case of a facsimile reception, or the like, the recording is executed by a printer 606.

In this respect, the above-mentioned display 601 may be a CRT, but it is desirable to use a flat panel such as a liquid crystal display using a ferroelectric liquid crystal because with such a display, it is possible to implement the miniaturization of the apparatus, and also, make it light. When the above-mentioned image processing apparatus functions as a personal computer or a word processor, the text information inputted through the keyboard unit 511 in FIG. 9 is processed by the control unit 501 in accordance with a given program, and is output to the printer unit 506 as images. When the apparatus functions as a receiver of the facsimile apparatus, the facsimile information inputted from a facsimile transmission and reception unit 508 is received by the control unit 501 for processing in accordance with a given program and is output to the printer unit 506 as reception images.

Figure 11:
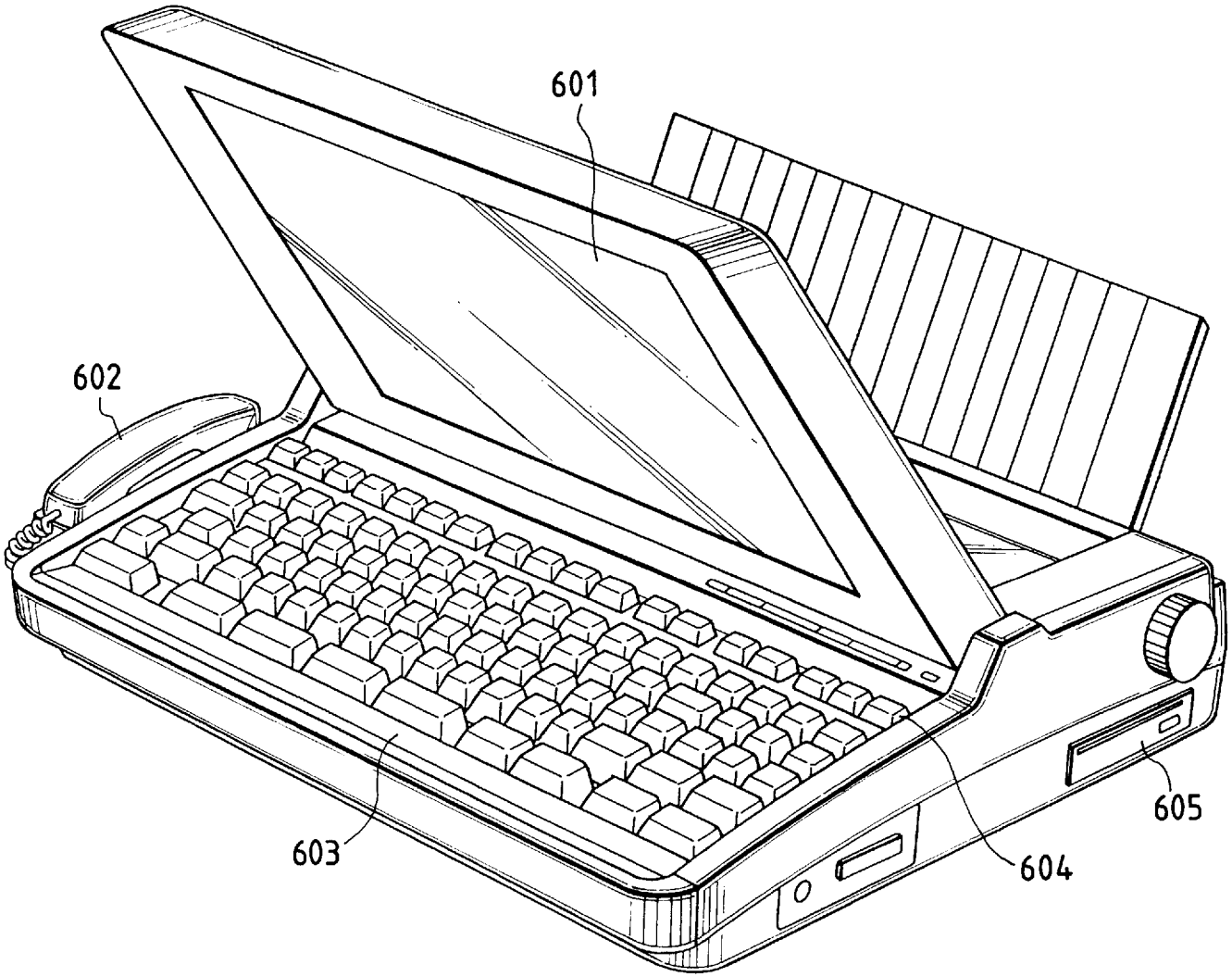
FIG. 11 is a view which shows the external appearance of an information processing apparatus provided integrally with a recording apparatus.

Also, when the apparatus functions as a copying apparatus, a source document is read by the image reader 507, and the data on the source document thus read are transferred to the printer unit 506 through the control unit 501 and are output as copied images. In this respect, when the apparatus functions as a transmitter of the facsimile apparatus, the data on the source documents read by the image reader 507 are processed by the control unit 501 for transmission in accordance with a given program, and then, transmitted to the communication line through the facsimile transmitter 508. Here, it may be possible to arrange the above-mentioned apparatus as an integrated type in which a printer is incorporated in the main body as shown in FIG. 11. In this case, the portability will be further enhanced. In FIG. 11, the constituents having the same functions as those shown in FIG. 10 are designated by the corresponding reference marks.

With the application of a recording apparatus of the present invention to a multi-functional information processing apparatus described above, it is possible to obtain a high-quality recording image, and at the same time, to enhance the functions of such apparatus still more.

As has been described in detail, the present invention makes it possible to obtain a desired image perfectly without any defective images, because even when a recording element of recording means malfunctions, the image data which should be assigned to such recording element are transferred to the image data assigned to other recording element, thus complementing the intended recording by use of the image data thus provided for the other recording element.

What is claimed is:

1. A recording apparatus for recording by discharging plural kinds of ink from a recording head to a recording medium, comprising:

detection means for detecting a decrease of ink remains of each ink of said plural kinds of ink;

at least one ink amount indication means for indicating the decrease of ink remains, said ink amount indication means being smaller in number than said plural kinds of ink; and signal outputting means for outputting signals enabling the decrease of ink remains of the ink having a least ink remains to be displayed on said ink amount indication means in accordance with results of plural detections by said detection means, wherein said ink amount indication means indicates the decrease of ink remains gradually, and said signal outputting means outputs a signal for causing said ink amount indication means to indicate the decrease of ink remains gradually.

2. A recording apparatus according to claim 1, wherein said plural kinds of ink are retained in an ink tank, and said signal outputting means outputs signals enabling the decrease of ink remains of the ink having the least ink remains to be displayed as the decrease of ink remains of the ink tank, in accordance with the results of plural detections by said detection means.

3. A recording apparatus for recording by discharging plural kinds of ink from a recording head to a recording medium, comprising:

first detection means for detecting a decrease of ink remains of a first ink tank retaining black ink;

second detection means for detecting a decrease of ink remains of a second ink tank retaining plural kinds of color ink other than black color;

first ink amount in dication means for indicating the decrease of ink remains of said first ink tank;

second ink amount indication means for indicating the decrease of ink remains of said second ink tank; and signal outputting means for outputting signals enabling the decrease of ink remains to be indicated on said first ink amount indication means in accordance with a result of detection by said first detection means, and outputting signals enabling the decrease of ink remains of the ink tank having a least ink remains to be indicated on said second ink amount indication means in accordance with results of plural detections by said second detection means, wherein said first ink amount indication means and said second ink amount indication means each indicates the decrease of ink remains gradually, and said signal outputting means outputs signals for causing said first ink amount indication means and said second ink amount indication means to indicate the decrease of ink remains gradually.

4. A recording apparatus according to claim 3, wherein said recording head is provided with ink discharge ports to discharge ink from said discharge ports onto a recording medium, and is provided with thermal energy generating elements creating a change of state of ink by applying heat in order to discharge ink from said discharge ports in accordance with said change of state.

5. An image forming apparatus for forming images by discharging plural kinds of ink from a recording head to a recording medium, comprising:

first detection means for detecting a decrease of ink remains of a first ink tank retaining black ink;

second detection means for detecting a decrease of ink remains of a second ink tank retaining plural kinds of color ink other than black color;

first ink amount indication means for indicating the decrease of ink remains of said first ink tank;

second ink amount indication means for indicating the decrease of ink remains of said second ink tank;

signal outputting means for outputting signals enabling the decrease of ink remains to be indicated on said first ink amount indication means in accordance with a result of detection by said first detection means, and outputting signals enabling the decrease of ink remains of the ink tank having a least ink remains to be indicated on said second ink amount indication means in accordance with results of plural detections by said second detection means; and means for reading images of a source document so as to form said images on the recording medium, wherein said first ink amount indication means and said second ink amount indication means each indicate the decrease of ink remains gradually, and said signal outputting means outputs signals for causing said first ink amount indication means and said second ink amount indication means to indicate the decrease of ink remains gradually.

6. An image forming apparatus for forming images by discharging plural kinds of ink from a recording head to a recording medium, comprising:

first detection means for detecting a decrease of ink remains of a first ink tank retaining black ink;

second detection means for detecting a decrease of ink remains of a second ink tank retaining plural kinds of color ink other than black color;

first ink amount indication means for indicating the decrease of ink remains of said first ink tank;

second ink amount indication means for indicating the decrease of ink remains of said second ink tank;

signal outputting means for outputting signals enabling the decrease of ink remains to be indicated on said first ink amount indication means in accordance with a result of detection by said first detection means, and outputting signals enabling the decrease of ink remains of the ink tank having a least ink remains to be indicated on said second ink amount indication means in accordance with results of plural detections by said second detection means; and means for transmitting and receiving image information so as to record said image information on the recording medium, wherein said first ink amount indication means and said second ink amount indication means each indicate the decrease of ink remains gradually, and said signal outputting means outputs signals for causing said first ink amount indication means and said second ink amount indication means to indicate the decrease of ink remains gradually.

7. An image forming apparatus for forming images by discharging plural kinds of ink from a recording head to a recording medium, comprising:

first detection means for detecting a decrease of ink remains of a first ink tank retaining black ink;

second detection means for detecting a decrease of ink remains of a second ink tank retaining plural kinds of color ink other than black color;

first ink amount indication means for indicating the decrease of ink remains of said first ink tank;

second ink amount indication means for indicating the decrease of ink remains of said second ink tank;

signal outputting means for outputting signals enabling the decrease of ink remains to be indicated on said first ink amount indication means in accordance with a result of detection by said first detection means, and outputting signals enabling the decrease of ink remains of the ink tank having a least ink remains to be indicated on said second ink amount indication means in accordance with results of plural detections by said second detection means; and means for inputting recording signals corresponding to images to be formed on the recording medium, wherein said first ink amount indication means and said second ink amount indication means each indicate the decrease of ink remains gradually, and said signal outputting means outputs signals for causing said first ink amount indication means and said second ink amount indication means to indicate the decrease of ink remains gradually.

8. An image forming apparatus according to claim 7, wherein said means for inputting recording signals is a keyboard.

9. An information processing apparatus comprising:

means for calculation processing; and an image forming apparatus for forming images by discharging plural kinds of ink from a recording head to a recording medium, said image forming apparatus including first detection means for detecting a decrease of ink remains of a first ink tank retaining black ink, second detection means for detecting a decrease of ink remains of a second ink tank retaining plural kinds of color ink other than black color, first ink amount indication means for indicating the decrease of ink remains of said first ink tank, second ink amount indication means for indicating the decrease of ink remains of said second ink tank, and signal outputting means for outputting signals enabling the decrease of ink remains to be indicated on said first ink amount indication means in accordance with a result of detection by said first detection means, and outputting signals enabling the decrease of ink remains of the ink tank having a least ink remains to be indicated on said second ink amount indication means in accordance with results of plural detections by said second detection means, wherein said first ink amount indication means and said second ink amount indication means each indicate the decrease of ink remains gradually, and said signal outputting means outputs signals for causing said first ink amount indication means and said second ink amount indication means to indicate the decrease of ink remains gradually.

10. A method for indicating a decrease of ink remains for a recording apparatus for recording by discharging plural kinds of ink from a recording head to a recording medium, comprising the steps of:

providing ink amount indication means in a number smaller than the number of said plural kinds of ink;

detecting each ink remains of said plural kinds of ink; and indicating the decrease of ink remains of the ink having a least ink remains on one of said ink amount indication means in accordance with results of said plural detections, wherein said indicating is performed gradually.

11. A recording apparatus for recording by discharging ink from a recording head to a recording medium, comprising:

detection means for detecting a decrease of remains of said ink;

indication means for indicating a result of detection by said detection means; and updating means for updating the result of detection to be indicated on said indication means in accordance with the result of detection output from said detection means when a given operation is completed by said recording apparatus, wherein said indication means indicates the decrease of ink remains gradually, and said updating means updates the result of detection to be indicated on said indication means to cause said indication means to indicate the decrease of ink remains gradually.

12. A recording apparatus according to claim 11, wherein said updating means updates the result of detection to be indicated on said indication means in accordance with the result of detection output from said detection means when one-page recording is completed by said recording apparatus.

13. A recording apparatus according to claim 11, wherein said indication means indicates a remaining amount of ink in plural increments, and said updating means updates the result of detection to be indicated on said indication means in accordance with the result of detection output from said detection means when ink is consumed in an amount equivalent to one increment of said indication means.

* * * * *

UNITED STATES PATENT AND TRADEMARK OFFICE

CERTIFICATE OF CORRECTION

PATENT NO. : 5,818,471

DATED : October 6, 1998

INVENTOR(S) : YOSHIYUKI SHIMAMURA

It is certified that error appears in the above-identified patent and that said Letters Patent is hereby corrected as shown below:

COLUMN 6

Line 5, "increment an" should read --one increment on--.

COLUMN 11

Line 4, "in dication" should read --indication--; and
Line 18, "indicates" should read --indicate--.

Signed and Sealed this

Twenty-fifth Day of April, 2000

*Attest:*

*Attesting Officer*

Q. TODD DICKINSON

*Director of Patents and Trademarks*